US008195072B2

(12) United States Patent
Okuno

(10) Patent No.: US 8,195,072 B2
(45) Date of Patent: Jun. 5, 2012

(54) SLIDING SHEET FOR FIXING DEVICES, MANUFACTURING METHOD FOR SAME, FIXING DEVICE, AND IMAGE FORMING APPARATUS

(75) Inventor: Jinju Okuno, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 402 days.

(21) Appl. No.: 12/169,369

(22) Filed: Jul. 8, 2008

(65) Prior Publication Data

US 2009/0014942 A1 Jan. 15, 2009

(30) Foreign Application Priority Data

Jul. 9, 2007 (JP) ..... 2007-179675

(51) Int. Cl.
*G03G 15/20* (2006.01)

(52) U.S. Cl. ..... 399/322; 399/122; 399/320

(58) Field of Classification Search ..... 399/322, 399/122, 320
See application file for complete search history.

(56) References Cited

U.S. PATENT DOCUMENTS 6,456,819 B1 9/2002 Abe et al.
7,447,474 B2 11/2008 Fujino
2004/0131401 A1* 7/2004 Nakatogawa et al. ..... 399/328
2006/0083567 A1* 4/2006 Ito et al. ..... 399/400
2006/0245800 A1 11/2006 Fujino

FOREIGN PATENT DOCUMENTS

| | | |
|---|---|---|
| JP | 2001-42670 | 2/2001 |
| JP | 2002-299007 | 10/2002 |
| JP | 2003-107936 | 4/2003 |
| JP | 2005-3969 | 1/2005 |
| JP | 2005-84484 | 3/2005 |
| JP | 2005-91557 | 4/2005 |
| JP | 2006-309079 | 11/2006 |

OTHER PUBLICATIONS

Office Action mailed Mar. 27, 2012, directed to Japanese Application No. 2007-179675; 13 pages.

* cited by examiner

*Primary Examiner* — David Gray
*Assistant Examiner* — Roy Y Yi
(74) *Attorney, Agent, or Firm* — Morrison & Foerster LLP

(57) ABSTRACT

A sliding sheet for fixing devices in the present invention is inserted in between an endless belt constituting one member out of two members which form a nip section for fixing operation and a pressure member for pressing the endless belt from an inner surface side toward the other member out of the two members. The sliding sheet, which is made of a single resin, repeatedly has a thick section and a thin section at least with respect to a sliding direction of the endless belt due to substantial difference in resin amount per unit area corresponding to positions within a sheet surface.

18 Claims, 11 Drawing Sheets

SLIDING SHEET FOR FIXING DEVICES, MANUFACTURING METHOD FOR SAME, FIXING DEVICE, AND IMAGE FORMING APPARATUS

This application is based on an application No. 2007-179675 filed in Japan, the contents of which are hereby incorporated by reference.

BACKGROUND OF THE INVENTION

The present invention relates to a sliding sheet for fixing devices and a manufacturing method for the same. More specifically, the present invention relates to a sliding sheet inserted in between an endless belt constituting one member out of two members which form a nip section for fixing operation and a pressure member for pressing the endless belt from an inner surface side toward the other member out of the two members, and to a manufacturing method for the same.

The present invention also relates to a fixing device having such a sliding sheet and to an image forming apparatus having the fixing device.

General fixing devices include one having a sheet (referred to as a "sliding sheet") inserted in between an endless belt constituting one member out of two members which form a nip section for fixing operation and a pressure member for pressing the endless belt from an inner surface side toward the other member out of the two members so as to reduce the sliding resistance of the endless belt. Further, oil as lubricant is fed to the inner surface of the endless belt in order to reduce friction between the inner surface of the endless belt and the sliding surface (surface in contact with the endless belt) of the sliding sheet.

Conventionally known sliding sheets of this kind include, as shown in FIG. 11, one prepared by impregnating a glass cloth 908 as a base material with PTFE (polytetrafluoroethylene) 907 or a heat-resistant resin and calcinating the glass cloth 908. Since the sliding sheet has a sliding surface 907S with unevenness which reflects the unevenness of the glass cloth 908, the unevenness retains the oil fed to the inner surface of the endless belt and thereby reduces the friction of the sliding sheet with the inner surface of the endless belt (if the sliding surface is flat, the oil is pushed out from a region equivalent to the nip section with pressure, resulting in failure in sufficient reduction of the friction).

There is also known a sliding sheet, as shown in FIG. 12, which is prepared by bonding a glass cloth 808 as a base material to a PTFE sheet 807 obtained by skiving (shaving) a compression-molded PTFE material.

Moreover, it is proposed in JP 2005-3969 A to place a metal wire mesh onto a heat resistant resin sheet (PTFE sheet) and press it in a heated state to cause plastic deformation, so that grid-like unevenness is given to the PTFE sheet. Similarly, in JP 2003-107936 A, it is proposed to press a sharp tip to a polyimide resin to cause plastic deformation so as to gain unevenness.

Moreover, it is proposed in JP 2002-299007 A to print a glass coat on a base material through thick film printing and to calcinate the base material to gain unevenness.

However, it cannot be said that the sliding sheet of FIG. 11 has enough wear resistance. More specifically, the sliding sheet of FIG. 11 has a problem that not only the sliding surface 907S is abraded away and flattened to cause increase in coefficient of friction but also worn powder generated by abrasion is mixed into oil so that apparent viscosity of the oil is increased, resulting in torque increase.

Since the sliding sheet of FIG. 12 has the PTFE sheet 807 prepared by skiving a compression-molded PTFE material, its wear resistance is superior to that of the sliding sheet of FIG. 11 (impregnated with PTFE). However, the sliding sheet of FIG. 12 has a disadvantage that the process for laminating and bonding the PTFE sheet 807 onto the glass cloth 808 is expensive and causes cost increase.

In the methods disclosed in JP 2005-3969 A and JP 2003-107936 A, the glass cloth is disused, which makes it possible to reduce cost. However, in the methods for gaining unevenness by pressing patterns such as embossing or by pressing sharp objects, the unevenness is eventually lost due to heat and pressure of the nip section. Accordingly, the coefficient of friction may increase, and this may cause a problem that the fixing quality cannot be maintained.

In the method disclosed in JP 2002-299007 A, the glass is higher in coefficient of friction than the fluororesin, which may cause a problem of torque increase during start-up i.e., during the time when oil does not yet fully sit on the sliding surface of the sliding sheet.

SUMMARY OF THE INVENTION

Accordingly, an object of the present invention is to provide a sliding sheet for fixing devices which can maintain a stable shape and which can be manufactured at a low cost and a manufacturing method for the same.

Another object of the invention is to provide a fixing device having such a sliding sheet and an image forming apparatus having the fixing device.

In order to accomplish the above object, the sliding sheet according to one aspect of the present invention is a sliding sheet for fixing devices inserted in between an endless belt constituting one member out of two members which form a nip section for fixing operation and a pressure member for pressing the endless belt from an inner surface side toward the other member out of the two members, wherein the sliding sheet comprises a single resin, and repeatedly has a thick section and a thin section at least with respect to a sliding direction of the endless belt due to substantial difference in resin amount per unit area corresponding to positions on a sheet surface.

The term "resin amount per unit area" herein refers to number of the resin molecules which constitute each divided section when the sliding sheet is divided per sheet unit area. The term "substantial difference in resin amount" refers to the difference in resin amount per unit area corresponding to positions on the sheet surface in the state where external force is not applied to the resin and where plastic deformation is not incurred either. Contrary to the present invention, in the sliding sheets disclosed in JP 2005-3969 A and JP 2003-107936 A, the unevenness is formed by plastic deformation of the resin, and the resin amount per unit area within the sheet surface is substantially constant.

The above described sliding sheet repeatedly has a thick section and a thin section substantially corresponding to positions on the sheet surface at least with respect to the sliding direction of the endless belt. Therefore, unlike the sliding sheets disclosed in JP 2005-3969 A and JP 2003-107936 A, the above sliding sheet does not return to its original flat shape even in the state of being exposed to heat and pressure for fixing operation, and so the shape of the sliding sheet is maintained stable. With the difference in thickness between the thick section and the thin thickness, high slidability against the endless belt is maintained. This makes it possible to maintain fixing quality. Moreover, the sliding sheet is formed only by locally changing the thickness of a single resin. Therefore, the sliding sheet may be manufactured at a low cost.

The manufacturing method according to one aspect of the present invention is a manufacturing method for a sliding sheet for fixing devices, the sliding sheet being inserted in between an endless belt constituting one member out of two members which form a nip section for fixing operation and a pressure member for pressing the endless belt from an inner surface side toward the other member out of the two members, the sliding sheet comprising a single resin, and repeatedly having a thick section and a thin section at least with respect to a sliding direction of the endless belt due to substantial difference in resin amount per unit area corresponding to positions on a sheet surface, the manufacturing method comprising:

preparing a support base having, on a support face for supporting a polishing object, a plurality of projections respectively placed corresponding to the thin sections of the sliding sheet to be manufactured;

attaching a sheet material, which is made of a single resin having a fixed thickness, to the support face is of the support base so as to be mounted on a plurality of the projections; and forming the thin section by slidably moving a polishing pad which is placed in contact with the sheet material from an opposite side to the support base so that the resin in regions corresponding to the respective projections on a surface of the sheet material which is in contact with the polishing pad is removed in an amount relatively larger than that of the resin in other remaining regions.

According to the manufacturing method for the sliding sheet, the sliding sheet can be manufactured at a low cost with use of a sheet material made of a single resin having a fixed thickness.

The sheet material should preferably be obtained by skiving (shaving) compression-molded resin. In that case, the sheet material is superior in wear resistance to the resin which is not compressed.

The fixing device according to one aspect of the present invention is a fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet comprises a single resin, and repeatedly has a thick section and a thin section at least with respect to a sliding direction of the endless belt due to substantial difference in resin amount per unit area corresponding to positions on a sheet surface.

In this fixing device, the sliding sheet can maintain a stable shape, so that high slidability against the endless belt can be maintained with the difference in thickness between the thick section and the thin section. This makes it possible to maintain fixing quality. Moreover, the sliding sheet is formed only by locally changing the thickness of a single resin and therefore can be manufactured at a low cost. Therefore, the fixing device may also be manufactured at a low cost.

An image forming apparatus according to one aspect of the present invention includes the fixing device.

BRIEF DESCRIPTION OF THE DRAWINGS

The present invention will become more fully understood from the detailed description given hereinbelow and the accompanying drawings, which are given by way of illustration only and thus are not limitative of the present invention, and wherein.

DETAILED DESCRIPTION OF THE INVENTION

Hereinbelow, the present invention will be described in details in conjunction with the embodiments with reference to the drawings.

Figure 1:
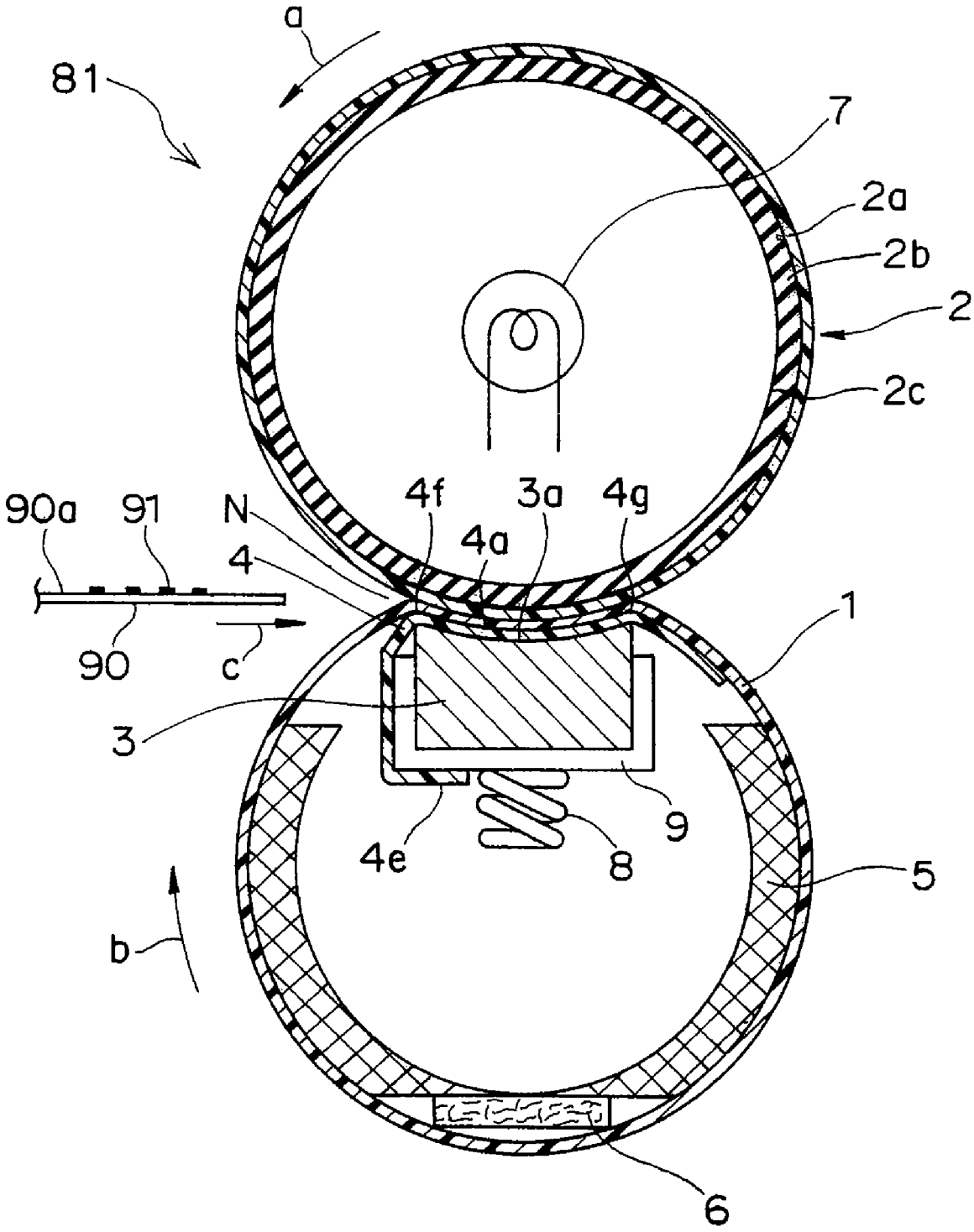
FIG. 1 is a view showing a cross sectional configuration of a fixing device having a sliding sheet in one embodiment of the present invention.
Figure 13:
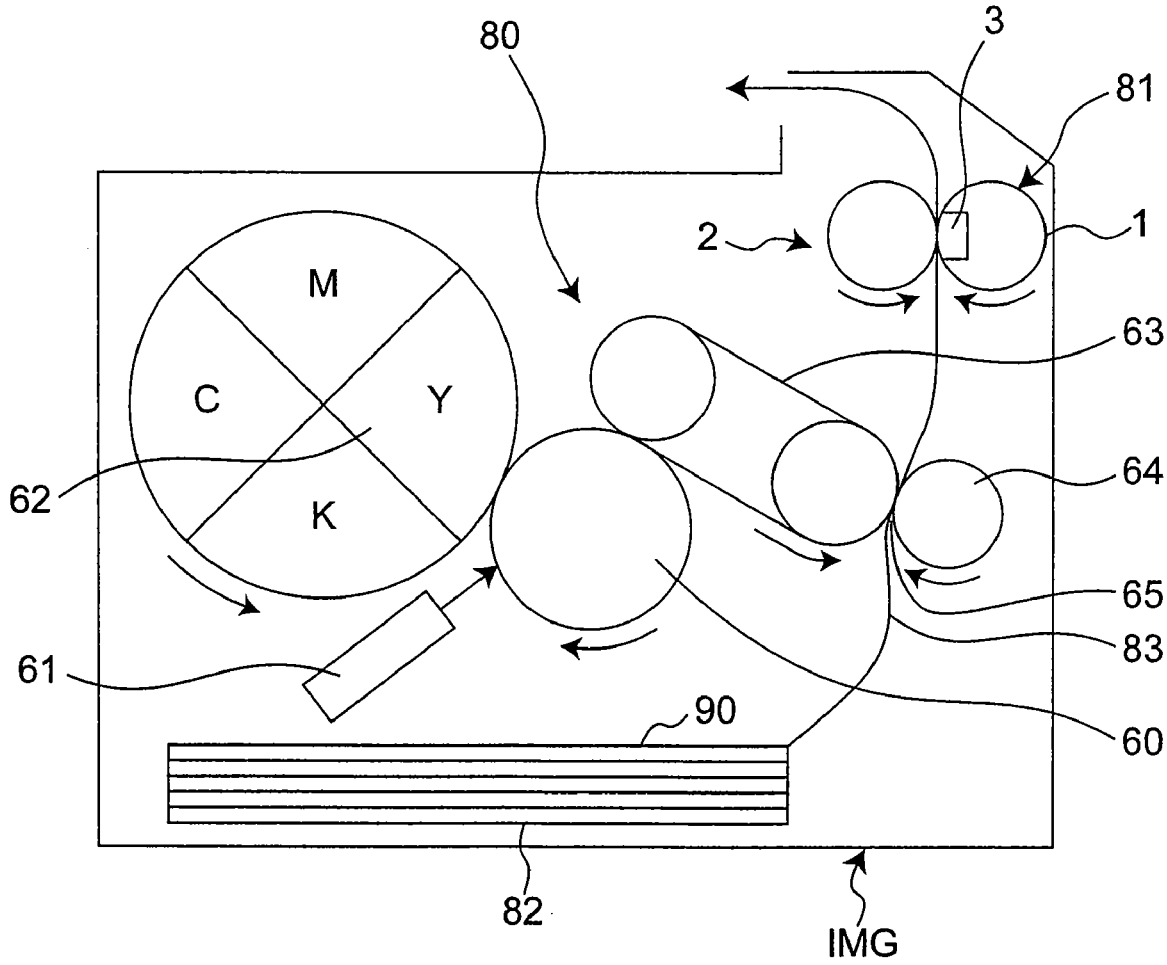
FIG. 13 is a schematic configuration view showing an image forming apparatus in one embodiment of the present invention.

FIG. 1 shows a cross sectional configuration of a fixing device 81 having a sliding sheet 4 in one embodiment of the present invention, and FIG. 13 shows a schematic configuration of an electrophotographic color printer IMG as one example of an image forming apparatus incorporating the fixing device 81.

The color printer IMG has a photoconductor drum 60 generally in the center of a casing which is rotated clockwise in this example. Provided around the photoconductor drum 60 are an unshown charging section for uniformly charging the photoconductor drum surface, an exposure section 61 for exposing the photoconductor drum surface which is uniformly charged to form a latent image thereon, a developing section 62 for attaching toner of respective colors, cyan (C), magenta (M), yellow (Y) and black (K), to the photoconductor drum surface with the latent image formed thereon and developing the image, an intermediate transfer belt 63 onto which a toner image attached to the photoconductor drum surface is transferred, and an unshown electric discharge section for discharging the photoconductor drum surface. The intermediate transfer belt 63 is put in pressure contact with a transfer roller 64 so that a nip section 65 for transfer is formed between the intermediate transfer belt 63 and the transfer roller 64. At the time of image formation, recording materials (e.g., paper) 90 are sent into the nip section 65 for transfer via a conveyance path 83 from a paper cassette, where a toner image is attached to one side of the recording material 90. The fixing device 81 melts toner 91 and fixes it to the recording material 90. The other components of the color printer IMG except the fixing device 81 are generally denoted by the reference number 80 as a image forming section.

It is to be noted that any image forming apparatus including not only printers but also copying machines and multifunctional peripherals (MFPs) may be used as long as they form toner images formed on recording materials.

As shown in FIG. 1, the fixing device 81 is composed of a heating roller 2 and a pressure belt 1 as an endless belt in order to form a nip section N for fixing operation.

The heating roller 2, which has three layers composed of a cored bar 2*c* made of metal such as aluminum, a middle layer 2*b* made of a rubber material with elasticity and a surface 2*a* made of fluororesin with releasability, is structured in general as a cylindrical shape elongated vertically with respect to the page of FIG. 1. A heater 7 for heating the heating roller 2 to a temperature suitable for fixing operation is provided inside the heating roller. The heating roller 2 is rotatably supported by an unshown frame, and is rotated around a central axis in the direction of arrow a by an unshown rotating mechanism.

The pressure belt 1 in this example is composed of a base material made of polyimide resin with thermal resistance and a surface layer (not shown) made of fluororesin provided on its outer face. The pressure belt 1 is provided so as to surround a generally semi-cylindrical guide member 5 fixed to the frame. Provided inside the pressure belt 1 are a holder member 9 with a horseshoe-shaped cross section, a pressure member 3 housed in the holder member 9 and a pressing member (a spring in this example) 8 for pressing the pressure member 3 toward the heating roller 2 with the holder member 9.

The pressure member 3 is made of a rubber material with elasticity in this example. A press surface 3*a* of the pressure member 3 is processed to have a recessed cross section corresponding to the radius of curvature of the heating roller 2.

A sliding sheet 4 for reducing the sliding resistance of the pressure belt 1 is inserted in between the inner surface of the pressure belt 1 and the press surface 3*a* of the pressure member 3. An end section 4*e* of the sliding sheet 4, which is equivalent to an upstream of a portion corresponding to the nip section N (a portion from 4*f* to 4*g* in the cross sectional view of FIG. 1), is engaged with the holder member 9. The sliding sheet 4 is made of a single fluororesin or PTFE (Polytetrafluoroethylene) in this example. PTFE is excellent in thermal resistance, high slidability and wear resistance. Among these characteristics, the wear resistance is particularly high.

As the pressing member 8 presses the pressure belt 1 toward the heating roller 2 via the sliding sheet 4, a part of the sliding sheet 4 and the pressure belt 1 curve along the outer face of the heating roller 2. Accordingly, a required size for the nip section N is secured with respect to a conveyance direction of the recording material 90.

Further, an oil application felt 6 for feeding oil as lubricant to the inner surface of the pressure belt 1 is provided in between the guide member 5 and the pressure belt 1. The oil reduces friction between the inner surface of the pressure belt 1 and a sliding surface (surface in contact with the pressure belt 1) 4*a* of the sliding sheet 4. More specifically, viscosity of the oil should preferably be 50 cs-500 cs. The oil of 300 cs was used in this example.

The width direction size of the pressure belt 1 is generally congruous with the axial size of the heating roller 2. The holder member 9, the pressure member 3, the sliding sheet 4, the guide member 5 and the oil application felt 6 are extendedly provided in a thin and long manner along the heating roller 2, with their longitudinal direction size being generally congruous with the axial size of the heating roller 2.

As the heating roller 2 rotates in the direction of arrow a, the pressure belt 1 rotates following after the rotation in the direction of arrow b. With the heater 7, the temperature of the heating roller 2 is increased to a target temperature suitable for fixing operation. In this state, a recording material (e.g., paper) 90 with the toner 91 attached to one side 90*a* is conveyed through the nip section N in the direction of arrow c. Accordingly, the toner 91 is melted by application of heat and pressure and is fixed to the recording material 90.

Figure 2:
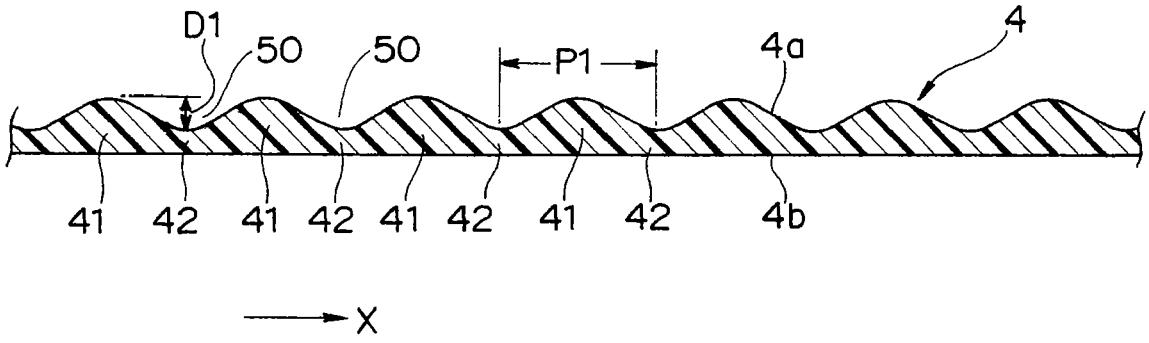
FIG. 2 is a schematic view showing a cross section of the above-mentioned sliding sheet in a natural state.

FIG. 2 schematically shows the cross section of the above-mentioned sliding sheet 4 in the natural state, i.e., in the state where no external force is applied and therefore no plastic deformation is incurred. It is to be noted that FIG. 2 shows the cross section cut along the sliding direction X of the pressure belt 1 shown in FIG. 1. As shown in FIG. 2, the sliding sheet 4 repeatedly has a thick section 41 and a thin section 42 substantially corresponding to positions within the sheet surface at a pitch P1. In short, local difference in resin amount (number of the resin molecules which exist per unit area) corresponding to positions in the sheet surface generates the difference in thickness.

Thus, the sliding sheet 4 repeatedly has a thick section 41 and a thin section 42 substantially corresponding to positions within the sheet surface at least with respect to the sliding direction X of the pressure belt 1. Therefore, unlike the sliding sheets disclosed in JP 2005-3969 A and JP 2003-107936 A, the sliding sheet 4 does not return to its original flat shape even in the state of being exposed to heat and pressure for fixing operation, and so the shape of the sliding sheet is maintained stable. With the difference D1 in thickness between the thick section 41 and the thin section 42, high slidability against the pressure belt 1 is maintained. This makes it possible to maintain fixing quality. Moreover, the sliding sheet 4 is formed only by locally changing the thickness of a single resin. Therefore, the sliding sheet 4 may be manufactured at a low cost.

Moreover, in this example, each of the thin sections 42 is equivalent to a recess section 50 formed by locally removing the sliding surface 4*a* of the sheet material (PTFE) which should be in contact with the pressure belt 1. Therefore, the oil fed to the inner surface of the pressure belt 1 is retained by the unevenness of the sheet material so that the friction with the inner surface of the pressure belt 1 can be reduced and high slidability can be ensured. It is to be noted that the other surface 4*b* of the sliding sheet 4 (surface which is in contact with the pressure member 3) is flat.

More specifically, the thick section 41 of the sliding sheet 4 preferably has the thickness of 0.1 mm-0.13 mm. If the sliding sheet 4 is too thick, the recessed shape of the press surface 3*a* of the pressure member 3 will not be correctly reflected upon the pressure belt 1, which may result in failure. If the sliding sheet 4 is too thin, wrinkles are generated on the sliding sheet 4 disadvantageously. The depth of the recess section 50 (denoted by reference numeral D1 in FIG. 2.) is preferably set to, for example, 5 μm to 40 μm, and the pitch of the recess section 50 (denoted by reference numeral P1 in FIG. 2) is preferably set to, for example, 0.5 mm to 1.0 mm. The depth and pitch of the unevenness relate to the retention capacity of oil on the sliding sheet.

As mentioned above, the sliding sheet 4 repeatedly has the thick section 41 and the thin section 42 with respect to the sliding direction X, so that the high slidability against the pressure belt 1 may be obtained. Therefore, each recess section 50 may be, for example, a groove extending in the vertical direction (width direction of pressure belt 1) with respect to the page of FIG. 2. However, if the substantially thick section 41 and the thin section 42 corresponding to positions within the sheet surface are repeatedly provided not only in the sliding direction X of the pressure belt 1 but also in the width direction Y, still higher slidability may be achieved.

Figure 4:
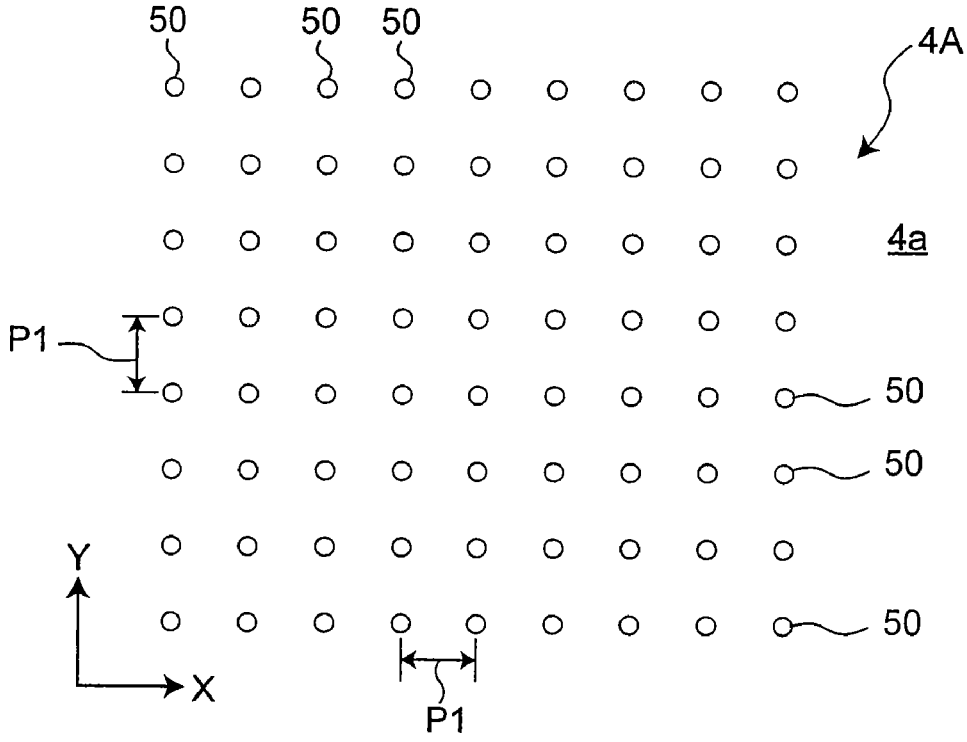
FIG. 4 is a view showing a plane layout of recess sections in a circular hollow shape placed at the lattice points at the same constant pitch in sliding direction X and in width direction Y within the sliding surface.

For example, FIG. 4 shows a plane layout 4A of recess sections 50 which are circular hollows placed at the lattice points at the same constant pitch P1 in two directions which are vertical to each other within the sliding surface 4*a*, i.e., in the sliding direction X and the width direction Y in this example. According to the plane layout 4A, the unevenness is obtained which is constituted of projections and hollows arranged at the lattice points at the same constant pitch P in the sliding direction X and in the width direction Y within the sliding surface 4*a*. Therefore, oil can be effectively retained by the unevenness. As a consequence, it becomes possible to further reduce the friction with the inner surface of the pressure belt 1 and to achieve high slidability.

Figure 5:
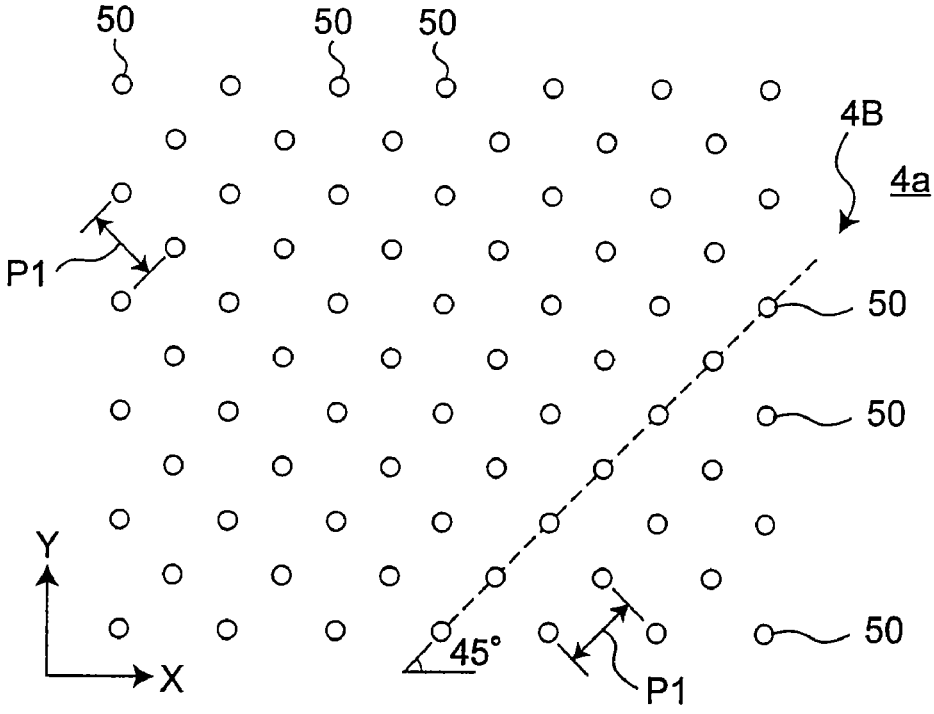
FIG. 5 is a view showing a plane layout of recess sections, the arrangement direction of which is inclined 45 degrees in the sliding direction X and the width direction Y within the sliding surface against the plane layout of FIG. 4.

FIG. 5 shows a plane layout 4B of recess sections 50, the arrangement direction of which is inclined 45 degrees in the sliding direction X and the width direction Y within the sliding surface 4*a* against the plane layout 4A of FIG. 4. According to the plane layout 4B, the unevenness is generated which is constituted of projections and hollows arranged at the lattice points at a constant pitch in the directions inclined 45 degrees with respect to the sliding direction X and the width direction Y within the surface of the resin which should be in contact with the pressure belt 1. In this case, as compared with the plane layout 4A of FIG. 4, the apparent density of the unevenness that the oil flowing along the sliding direction X may encounter increases. Therefore, oil can be effectively retained by the unevenness. As a consequence, it becomes possible to further reduce the friction with the inner surface of the pressure belt 1 and to achieve high slidability.

Although each recess section 50 is a circular hollow in the examples in FIG. 4 and FIG. 5, the present invention is not limited to this configuration.

Figure 6:
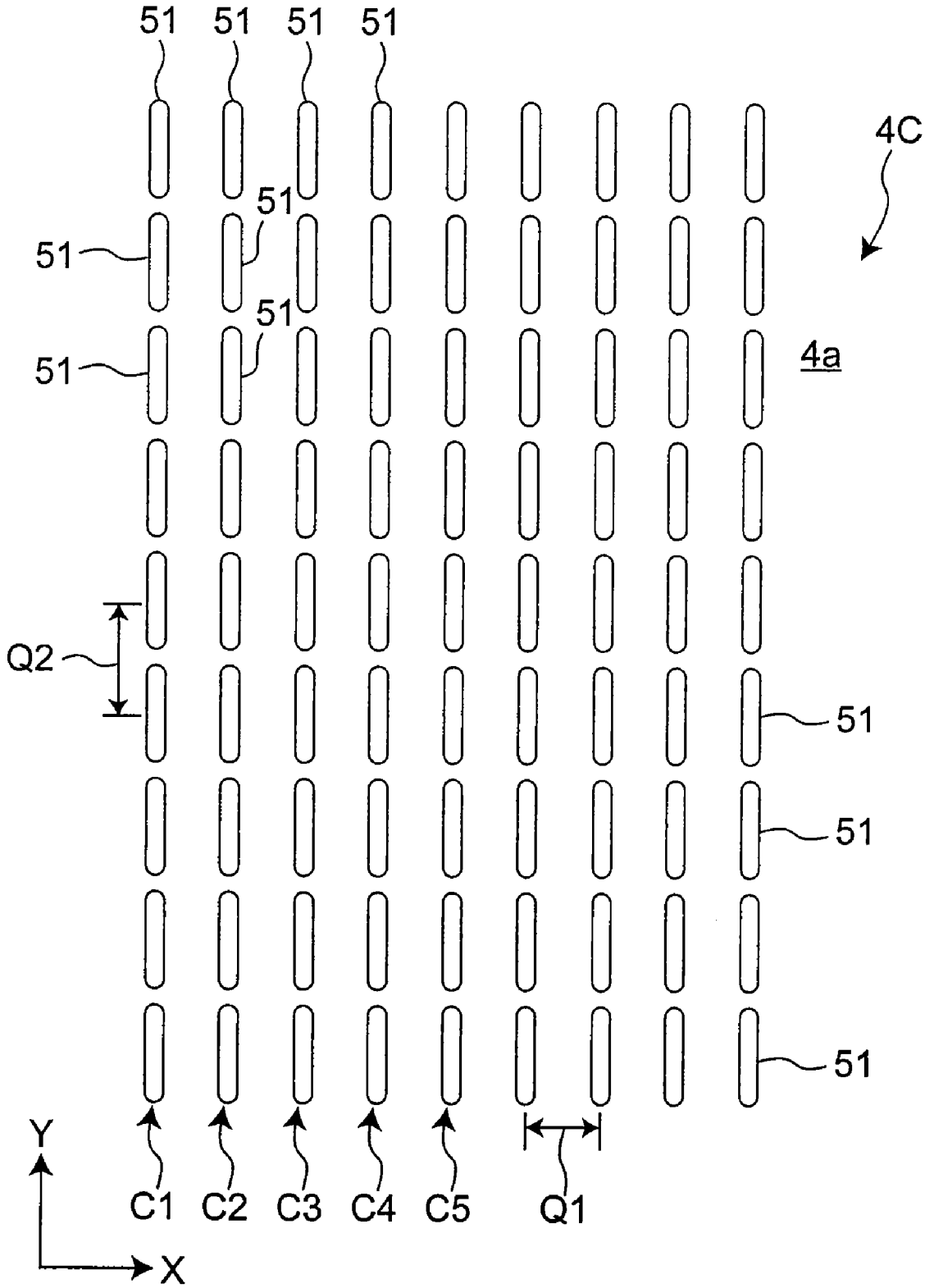
FIG. 6 is a view showing a plane layout of recess sections in an elongated oval shape extending in width direction Y, which are placed like a matrix at a constant pitch respectively in the sliding direction X and in the width direction Y.

For example, FIG. 6 shows the case where each recess section (denoted by reference numeral 51) is an elongated oval hollow extending in the width direction Y. In this case, the unevenness can be formed with high distribution density with respect to the sliding direction X within the sliding surface 4*a*. Therefore, the oil fed to the inner surface of the pressure belt 1 is retained by the unevenness of the sliding surface so that the friction with the inner surface of the pressure belt 1 can be reduced and high slidability can be ensured. Since each recess section 51 is an elongated oval hollow extending in the width direction Y, a flow of oil can be promoted along the width direction Y on the sliding surface. Therefore, the friction with the inner surface of the pressure belt 1 is equalized with respect to the width direction Y. It is to be noted that FIG. 6 shows a plane layout 4C in which a plurality of the recess sections 51 are placed like a matrix at a constant pitch Q1 in the sliding direction X and at a constant pitch Q2 in the width direction Y within the sliding surface 4*a*. Columns C1, C2, C3 . . . of the recess section 51 are placed similarly with respect to the width direction Y.

Figure 7:
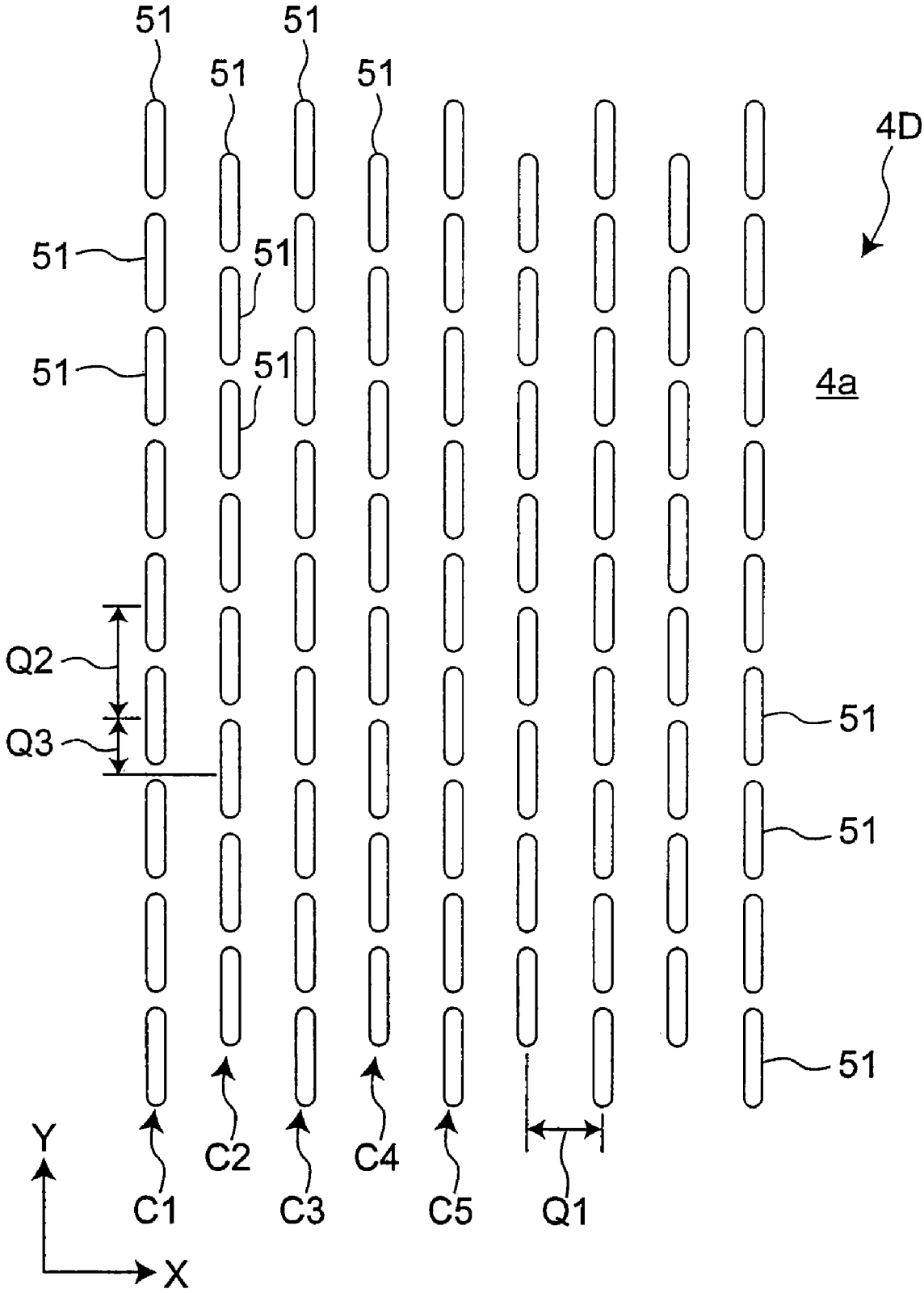
FIG. 7 is a view, in comparison to the plane layout of FIG. 6, showing a plane layout of two columns composed of a plurality of recess sections are adjacent to each other with respect to the sliding direction X within the sliding surface, the two columns being placed out of alignment with each other by ½ pitch with respect to the width direction Y.

In comparison to the plane layout 4C of FIG. 6, FIG. 7 shows a plane layout 4D in which two columns composed of a plurality of the recess sections 51 and adjacent to each other with respect to the sliding direction X within the sliding surface 4*a* are placed out of alignment with each other by ½ pitch with respect to the width direction Y. More specifically, even-numbered columns C2, C4, . . . are respectively placed out of alignment with odd-numbered columns C1, C3, . . . by ½ pitch. It is to be noted that Q3=(Q2)/2 in FIG. 7. According to the plane layout 4D, the oil which is going to flow in the sliding direction X moves in a zigzag direction on the sliding surface 4*a* because of the above-mentioned placement. Therefore, as compared with the plane layout 4C of FIG. 6, oil can effectively be retained by the unevenness. As a consequence, it becomes possible to further reduce the friction with the inner surface of the pressure belt 1 and to achieve high slidability. In addition, the flow of oil is promoted with respect to the width direction Y. Therefore, the friction with the inner surface of the pressure belt 1 is further equalized with respect to the width direction Y.

Although the distribution density of the recess sections 50 and 51 within the sliding surface 4*a* are constant in each of the above-mentioned examples, the present invention is not limited to this configuration.

Figure 8:
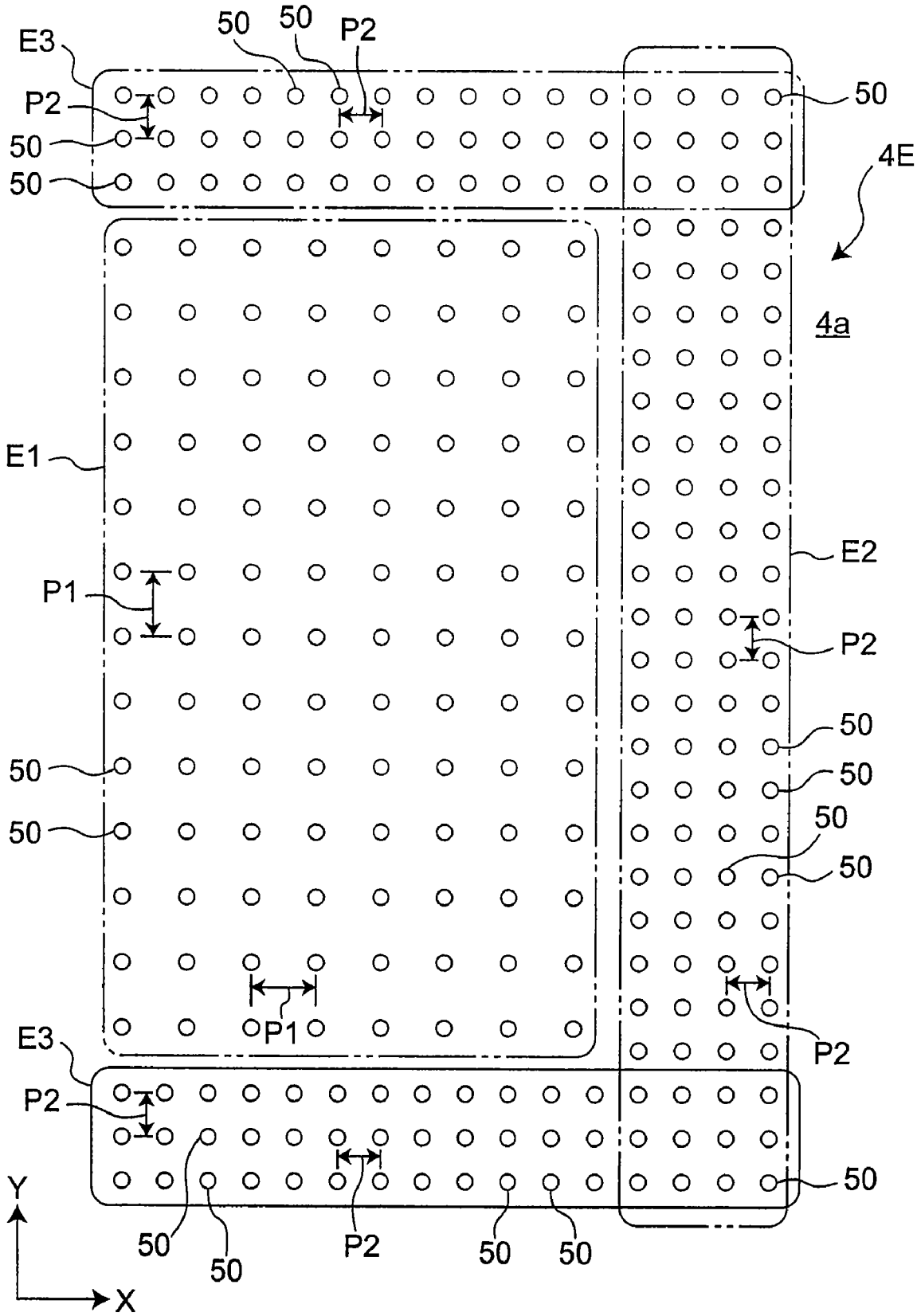
FIG. 8 is a view showing a plane layout of the recess sections with their distribution density varied corresponding to positions within the sliding surface.

For example, FIG. 8 shows a plane layout 4E in which the recess sections 50 have distribution density varied corresponding to positions within the sliding surface 4*a*. In the plane layout 4E, the distribution density of the recess sections 50 placed in a section E2 which is equivalent to a downstream area with respect to the sliding direction X within the sliding surface 4*a* is higher than the distribution density of the recess sections 50 placed in a section E1 which is equivalent to an upstream area. More specifically, in the upstream section E1, the recess sections 50 are placed like a matrix at the same constant pitch P1 with respect to the sliding direction X and the width direction Y. In the downstream section E2, the recess sections 50 are placed like a matrix at the same constant pitch P2 which is smaller than P1 with respect to the sliding direction X and the width direction Y. In this case, the oil which is going to flow in the sliding direction X tends to stagnate on the sliding surface 4*a*. Therefore, oil can effectively be retained on the sliding surface 4*a*. As a consequence, it becomes possible to further reduce the friction with the inner surface of the pressure belt 1 and to achieve high slidability. In the plane layout 4E, the distribution density of the recess sections 50 placed in both end sections E3 with respect to the width direction Y within the sliding surface 4*a* is higher than the distribution density of the recess sections 50 placed in a central section E1. More specifically, in the central section E1, the recess sections 50 are placed like a matrix at the same constant pitch P1 with respect to the sliding direction X and the width direction Y. In both the end sections E3, the recess sections 50 are placed like a matrix at the same constant pitch P2 which is smaller than P1 with respect to the sliding direction X and the width direction Y. In this case, the oil on the sliding surface 4*a* becomes less likely to escape from the central section E1 beyond both the end sections E3 with respect to the width direction Y. Therefore, oil can be effectively retained on the sliding surface 4*a*. As a consequence, it becomes possible to further reduce the friction with the inner surface of the pressure belt 1 and to achieve high slidability.

Figure 3A:
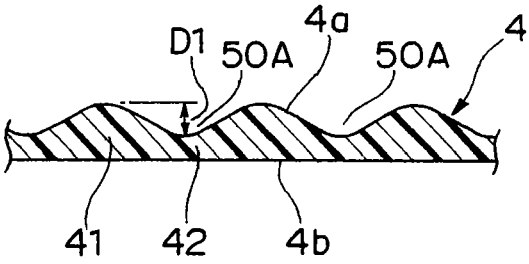
FIG. 3A is a view showing a cross section of a sliding sheet having a recess section with a certain depth.
Figure 3B:
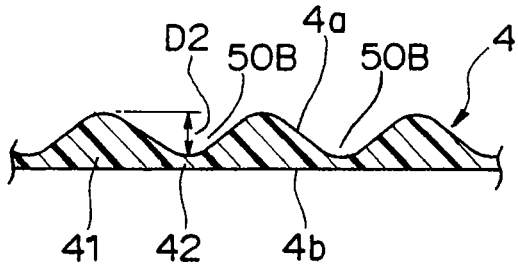
FIG. 3B is a view showing a cross section of a sliding sheet having a recess section with a larger depth than that of FIG. 3A.

It is to be noted that the depth of the recess sections 50 placed in the downstream section E2 with respect to the sliding direction X within the sliding surface 4*a* may be made larger than the depth of the recess sections 50 placed in the upstream section E1 in FIG. 8. For example, in the upstream section E1, the depth is set to D1 as with a recess section 50A shown in FIG. 3A, while in the downstream section E2, the depth is set to D2 (>D1) as with a recess section 50B shown in FIG. 3B. This increases the tendency that the oil which is going to flow in the sliding direction X stagnates on the sliding surface 4*a*. Therefore, oil can effectively be retained on the sliding surface 4*a*. As a consequence, it becomes possible to further reduce the friction with the inner surface of the pressure belt 1 and to achieve high slidability. Similarly, in FIG. 8, the depth of the recess sections 50 placed in both the end sections E3 with respect to the width direction Y within the sliding surface 4*a* may be larger than the depth of the recess sections 50 placed in the central section E1. As a consequence, the oil on the sliding surface 4*a* becomes further less likely to escape from the central section E1 beyond both the end sections E3 with respect to the width direction Y. Therefore, oil can effectively be retained on the sliding surface 4*a*. As a consequence, it becomes possible to further reduce the friction with the inner surface of the pressure belt 1 and to achieve high slidability.

Figure 9:
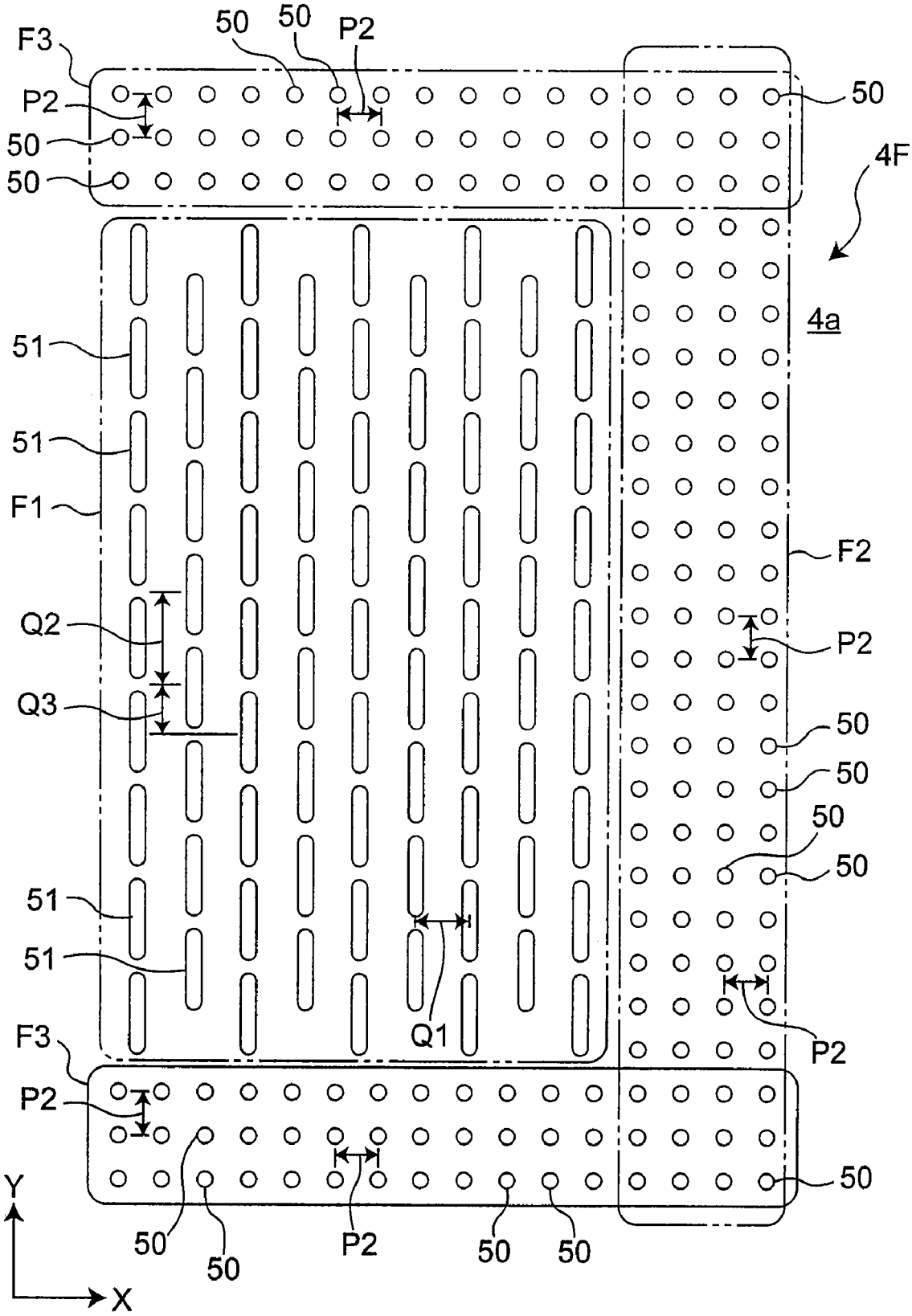
FIG. 9 is a view showing another plane layout of the recess sections with their distribution density changed corresponding to positions within the sliding surface.

FIG. 9 shows another plane layout 4F in which the recess sections have shapes and distribution density varied corresponding to positions within the sliding surface 4*a*. In this example, recess sections 51 which are elongated oval hollows extending in the width direction Y are placed in a section F1 which is equivalent to an upstream area with respect to the sliding direction X within the sliding surface 4*a* and is equivalent to a central section with respect to the width direction Y. The arrangement and the pitch of a plurality of the recess sections 51 in the section F1 are similar to those in the plane layout 4D shown in FIG. 7. This brings about advantages including reduction of friction as well as equalization of friction in the width direction Y.

In the plane layout 4F, recess sections 50 which are circular hollows are placed in a section F2 which is equivalent to a downstream area with respect to the sliding direction X within the sliding surface 4*a* and in a section F3 which is equivalent to both the end sections with respect to the width direction Y. The arrangement and the pitch of a plurality of the recess sections 50 in the sections F2 and F3 are similar to those of the sections E2 and E3 shown in FIG. 8. The size relation of the pitch is set as P2<Q1<Q2. Consequently, in the plane layout 4F, the distribution density of the recess sections 50 placed in the section F2 which is equivalent to a downstream area with respect to the sliding direction X within the sliding surface 4*a* is higher than the distribution density of the recess sections 51 placed in the section F1 which is equivalent to an upstream area. In this case, the oil which is going to flow in the sliding direction X tends to stagnate on the sliding surface 4*a*. Therefore, oil can effectively be retained on the sliding surface 4*a*. As a consequence, it becomes possible to further reduce the friction with the inner surface of the pressure belt 1 and to achieve high slidability. In the plane layout 4F, the distribution density of the recess sections 50 placed in both the end sections F3 with respect to the width direction Y within the sliding surface 4*a* is higher than the distribution density of the recess sections 51 placed in the central section F1. Therefore, the oil on the sliding surface 4*a* becomes less likely to escape from the central section F1 beyond both the end sections F3 with respect to the width direction Y. Therefore, oil can effectively be retained on the sliding surface 4*a*. As a consequence, it becomes possible to further reduce the friction with the inner surface of the pressure belt 1 and to achieve high slidability.

It is to be noted that as with the case of FIG. 8, the depth of the recess sections 50 placed in the sections F2 and F3 within the sliding surface 4*a* may be larger than the depth of the recess sections 51 placed in the section F1 in FIG. 9. This increases the tendency that the oil which is going to flow in the sliding direction X stagnates on the sliding surface 4*a*, and also decreases the likeliness that the oil on the sliding surface 4*a* escapes from the central section F1 beyond both the end sections F3 with respect to the width direction Y. Therefore, oil can effectively be retained on the sliding surface 4*a*. As a consequence, it becomes possible to further reduce the friction with the inner surface of the pressure belt 1 and to achieve high slidability.

Moreover, the distribution density and the depth of the recess sections 50 and 51 may not be changed in two stages with respect to the sliding direction X and the width direction Y within the sliding surface 4*a* but may each be changed in multi stages or be changed in succession. In any case, it is preferable that the distribution density of the recess sections is made sparse and shallow in the section (4*f* near the entrance of the nip section N in FIG. 1) which is equivalent to the upstream area with respect to the sliding direction X within the sliding surface 4*a* and that the distribution density of the recess sections is made dense and deep in the section (4*g* near the outlet of the nip section N in FIG. 1) equivalent to the downstream area. As a consequence, oil can effectively be retained on the sliding surface 4*a*. As a consequence, it becomes possible to further reduce the friction with the inner surface of the pressure belt 1 and to achieve high slidability.

As mentioned above, the sliding sheet 4 in the present embodiment has high oil retention capacity. Therefore, it becomes possible to use the oil with relatively low viscosity. In that case, it becomes possible to enhance the lubricity of oil to further reduce the friction with the inner surface of the pressure belt 1.

Although the sliding sheet 4 is made of PTFE (Polytetrafluoroethylene) in the above-mentioned example, the present invention is not limited to this configuration. The material of the sliding sheet 4 may be PTFE with higher molecular weight or PTFE containing filler. Further, PTFE powder may be sintered, compression-molded and then skived to prepare the sheet material. In that case, high wear resistance is preferably achieved.

FIG. 10A to FIG. 10E show the process of manufacturing the sliding sheet 4.

Figure 10A:
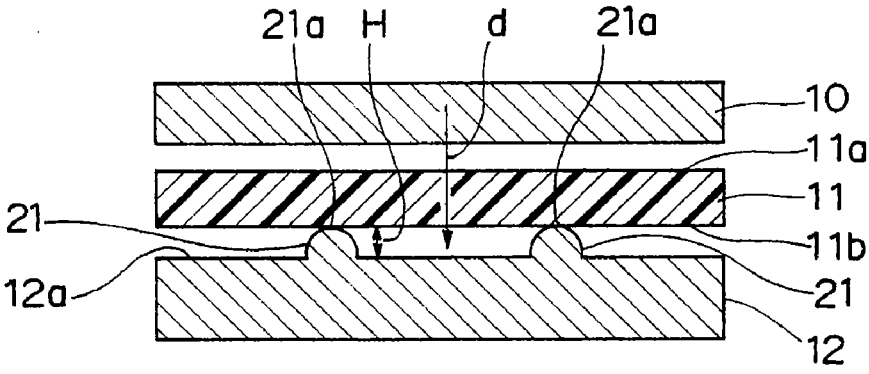
FIG. 10A is a view showing the manufacturing process of the sliding sheet.

First, as shown in FIG. 10A, a support base 12 having a plurality of projections 21 on a support face 12*a* for supporting a polishing object is prepared. A plurality of the projections 21 are each placed corresponding to thin sections 42 of a sliding sheet 4 which should be manufactured. In this example, the projection 21 on the support face 12*a* is formed into a column shape having a hemispherical top end in order to form a recess section 50 which is made of a circular hollow as shown in FIG. 4. Forming the top end of the projection 21 into a hemispherical convex curve is advantageous as a sheet material 11 is less likely to break during polishing operation compared to the projection having a sharp top end. A height H of the projection 21 is made to correspond to the depth of the recess section 50 to be formed.

Next, the sheet material 11 which is made of a single resin having a fixed thickness is attached to the support face 12*a* of the support base 12 so as to be mounted on a plurality of the projections 21. In this example, PTFE powder is sintered, compression-molded and then skived to prepare the sheet material 11.

Figure 10B:
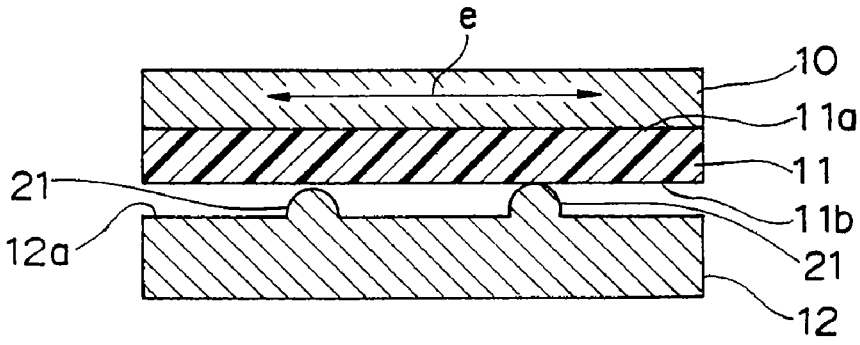
FIG. 10B is a view showing the manufacturing process of the sliding sheet.
Figure 10C:
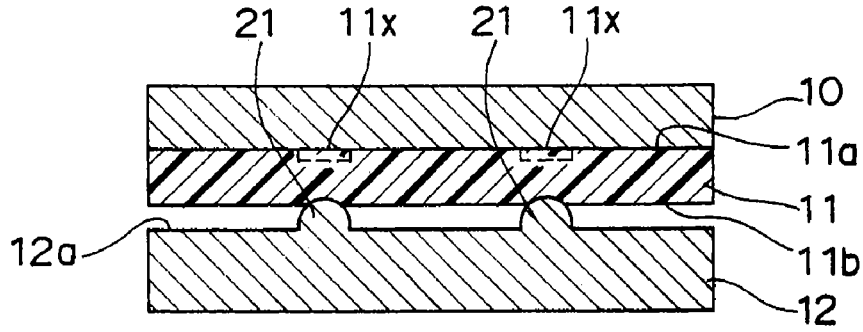
FIG. 10C is a view showing the manufacturing process of the sliding sheet.

Next, a polishing pad 10 is brought into contact with and pressed to the sheet material 11 from the opposite side to the support base 12 as shown with arrow d. Then, as shown in FIG. 10B, the polishing pad 10 is slidably moved against the sheet material 11 in the direction of arrow e, i.e., in the direction parallel to the support face 12*a* of the support base 12. In this case, as shown in a FIG. 10C, a region 11*x* on the surface 11*a* of the sheet material 11 (the surface in contact with the polishing pad 10) corresponding to each projection 21 is strongly pressed toward the polishing pad 10 due to the presence of each projection 21 as compared with the remaining regions. Accordingly, the resin of the region 11*x* is removed in an amount relatively larger than that in the remaining regions. The abraded amount in the remaining regions is slight.

Figure 10D:
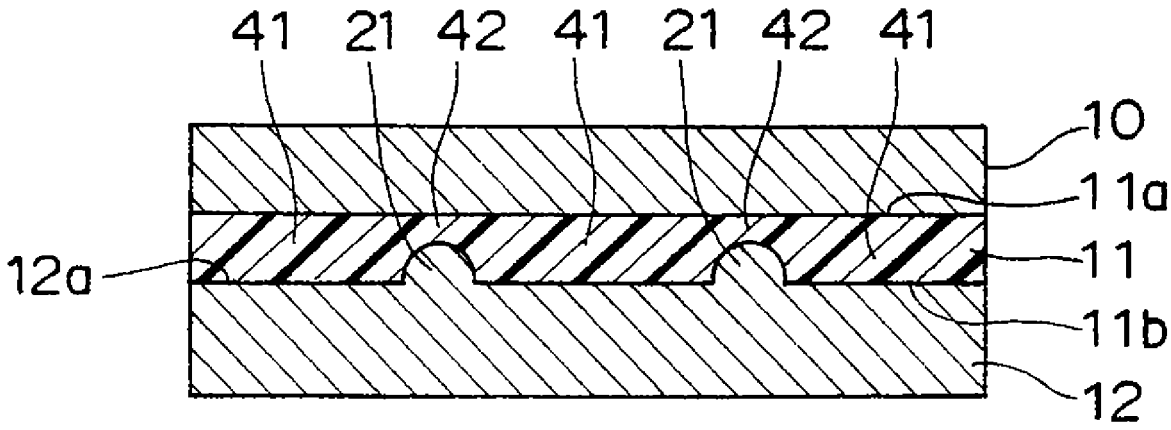
FIG. 10D is a view showing the manufacturing process of the sliding sheet.
Figure 10E:
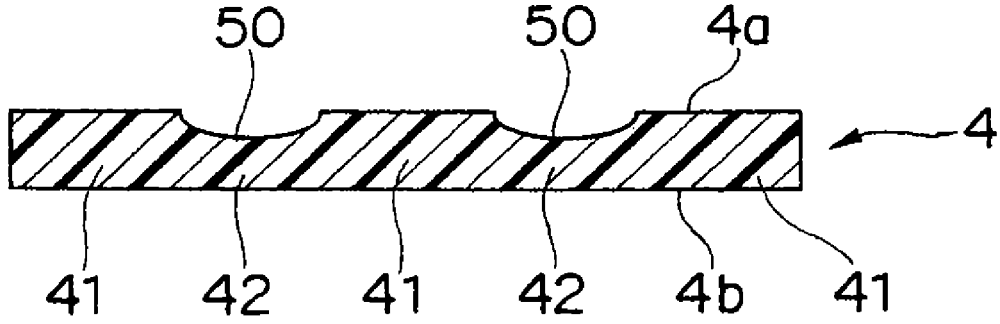
FIG. 10E is a view showing the manufacturing process of the sliding sheet.
Figure 11:
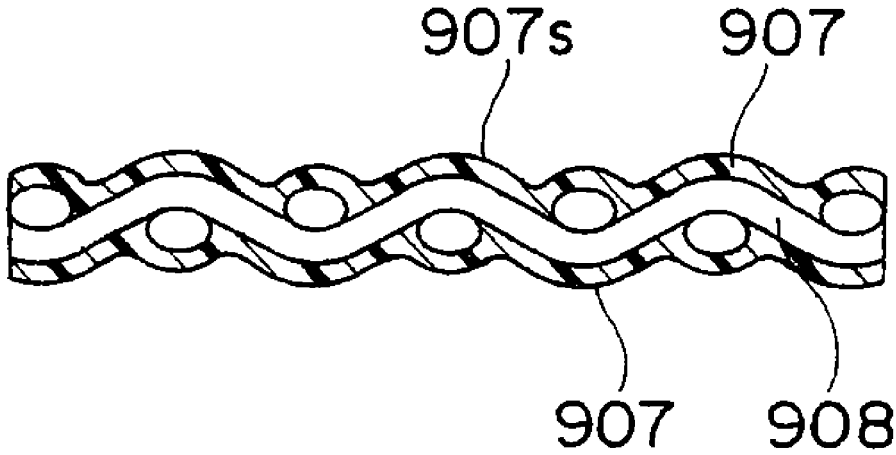
Fig.11 PRIOR ART
FIG. 11 is a view showing a cross sectional configuration of a conventional sliding sheet.
Figure 12:
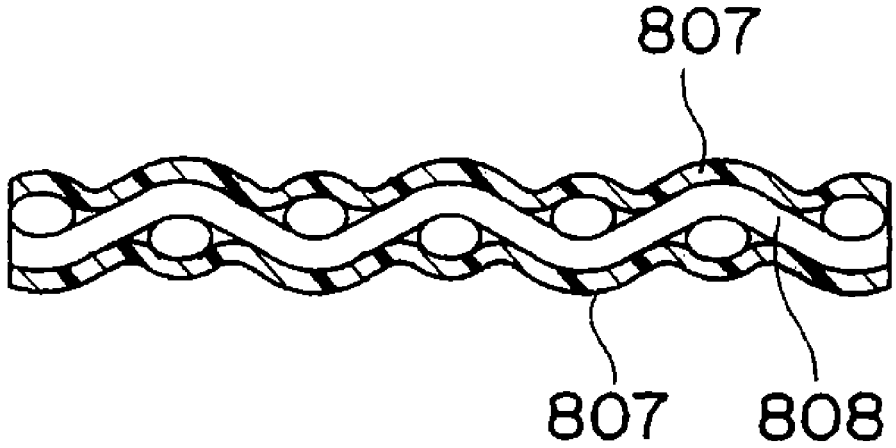
Fig.12 PRIOR ART
FIG. 12 is a view showing a cross sectional configuration of another conventional sliding sheet.

As shown in FIG. 10D, at the moment when the height of the polishing pad 10 reaches a desired height (thickness of the sliding sheet 4 to be manufactured) with respect to the support face 12*a* of the support base 12, the sliding movement of the polishing pad 10 is stopped and polishing is ended. Accordingly, as shown in FIG. 10E, a recess section 50 which is made of a circular hollow can be formed as a thin section 42 in a position corresponding to the projection 21 in the surface 4*a* of the sliding sheet 4 (i.e., the surface 11*a* of the sheet material 11). It is to be noted that at the end of polishing operation, the sheet material 11 is pressurized by the support base 12 and the polishing pad 10, with its back lib being in pressure contact with the support face 12*a* while its surface 11*a* being flattened as shown in FIG. 10D. However, after being taken out of a polishing apparatus, the sheet material 11 becomes free from pressure, so that as shown in FIG. 10E, the obtained sliding sheet 4 has a flat back 4*b* and a surface 4*a* with recess sections 50 thereon. The depth of the recess section 50, i.e., the difference in thickness between a thick section 41 and a thin section 42 of the sliding sheet 4, corresponds to a height H of the projection 21 on the support face 12*a* of the support base 12 (see FIG. 10A).

According to the manufacturing method for the sliding sheet, the sliding sheet 4 can be manufactured at a low cost with use of the sheet material 11 made of a single resin having a fixed thickness.

For manufacturing, for example, a sliding sheet with recess sections 50 placed at the lattice points as in plane layouts 4A and 4B as shown in FIG. 4 or FIG. 5, the projections 21 on the support face 12*a* of the support base 12 should be placed at the lattice points at a constant pitch in two directions vertical to each other within the support face 12*a*. For manufacturing, for example, a sliding sheet with the recess sections 51 made of elongated oval hollows as shown in FIG. 6, the projections on the support face 12*a* of the support base 12 should be formed into a pillar shape with a top end forming a convex curve and with a traverse section in elongated oval shape (a cross section parallel to the support face 12*a*). In order to obtain arrangement of the recess sections 51 (plane layout 4D) as shown in FIG. 6, the projections should be placed like a matrix at a constant pitch in two directions vertical to each other within the support face 12*a*. Thus, placement of the projections on the support face 12*a* of the support base 12 should be set corresponding to the arrangement (plane layout) of the recess sections on the sliding sheet to be manufactured.

It is to be noted that the manufacturing method for a sliding sheet is not limited to the method involving the polishing operation, but any method is applicable including a method involving etching process after masking as long as the recess sections can be formed so that a resin amount per unit area is substantially different depending on the positions in the sheet surface.

As described before, according to the sliding sheet 4, the difference in thickness between the thick section 41 and the thin section 42 makes it possible to maintain high slidability against the pressure belt 1 and to thereby maintain fixing quality. Accordingly, in the fixing device having the sliding sheet 4, fixing quality can be maintained. Moreover, the sliding sheet 4 is formed only by locally changing the thickness of a single resin and therefore can be manufactured at a low cost. Accordingly, the fixing device having the sliding sheet 4 may also be manufactured at a low cost.

As mentioned above, the sliding sheet according to the above described embodiments is a sliding sheet for fixing devices inserted in between an endless belt constituting one member out of two members which form a nip section for fixing operation and a pressure member for pressing the endless belt from an inner surface side toward the other member out of the two members, wherein the sliding sheet comprises a single resin, and repeatedly has a thick section and a thin section at least with respect to a sliding direction of the endless belt due to substantial difference in resin amount per unit area corresponding to positions on a sheet surface.

In the sliding sheet of one embodiment, the sliding sheet repeatedly has a thick section and a thin section substantially corresponding to positions on the sheet surface with respect to a width direction of the endless belt.

The sliding sheet in this embodiment repeatedly has a thick section and a thin section substantially corresponding to positions within the sheet surface not only with respect to the sliding direction but also to the width direction of the endless belt. Therefore, high slidability can be achieved.

In the sliding sheet of one embodiment, each of the thin sections is equivalent to a recess section formed by locally removing the sliding surface of the resin which should be in contact with the endless belt.

In the sliding sheet in this embodiment, unevenness is formed on the sliding surface. Therefore, the oil fed to the inner surface of the endless belt is retained by the unevenness of the sliding surface so that the friction with the inner surface of the endless belt can be reduced and high slidability can be ensured.

In the sliding sheet of one embodiment, the resin is fluororesin.

In the sliding sheet of this embodiment, the resin is fluororesin, which is excellent in thermal resistance, high slidability and wear resistance. Among these characteristics, the wear resistance is particularly high.

In the sliding sheet of one embodiment, the resin is polyimide resin.

In the sliding sheet of this embodiment, the resin is polyimide resin, which is excellent in thermal resistance, high slidability and wear resistance. Among these characteristics, the thermal resistance is particularly high.

In the sliding sheet of one embodiment, each of the recess sections is a circular hollow.

In the sliding sheet of this embodiment, the unevenness can be formed with high distribution density in the sliding surface. Therefore, the oil fed to the inner surface of the endless belt is retained by the unevenness of the sliding surface so that the friction with the inner surface of the endless belt can be reduced and high slidability can be ensured.

In the sliding sheet of one embodiment, a plurality of the recess sections are placed at lattice points at a constant pitch in two directions which are vertical to each other within the sliding surface.

In the sliding sheet of this embodiment, the unevenness is obtained constituted of projections and hollows arranged at the lattice points at the same constant pitch in two directions vertical to each other within the sliding surface. Therefore, oil can effectively be retained by the unevenness. As a consequence, it becomes possible to further reduce the friction with the inner surface of the endless belt and to achieve high slidability.

In the sliding sheet of one embodiment, an arrangement direction of a plurality of the recess sections is inclined 45 degrees in the sliding direction and the width direction within the sliding surface.

In the sliding sheet of this embodiment, the unevenness is generated which is constituted of projections and hollows arranged at the lattice points at a constant pitch in the directions inclined 45 degrees with respect to the sliding direction and the width direction within the surface of the resin which should be in contact with the endless belt. In this case, as compared with the case where a plurality of the recess sections are placed at the lattice points along the sliding direction and the width direction, the apparent density of the unevenness that the oil flowing along the sliding direction may encounter increases. Therefore, oil can effectively be retained by the unevenness. As a consequence, it becomes possible to further reduce the friction with the inner surface of the endless belt and to achieve high slidability.

In the sliding sheet of one embodiment, each of the recess sections is an elongated oval hollow extending in the width direction.

In the sliding sheet of this embodiment, the unevenness can be formed with high distribution density with respect to the sliding direction in the sliding surface. Therefore, the oil fed to the inner surface of the endless belt is retained by the unevenness of the sliding surface so that the friction with the inner surface of the endless belt can be reduced and high slidability can be ensured. Since each recess section is an elongated oval hollow extending in the width direction, the flow of oil can be promoted along the width direction on the sliding surface. Therefore, the friction with the inner surface of the endless belt is equalized with respect to the width direction.

In the sliding sheet of one embodiment, a plurality of the recess sections are placed like a matrix at a constant pitch respectively in the sliding direction and the width direction within the sliding surface.

In the sliding sheet of this embodiment, the unevenness can be formed with high distribution density with respect to the sliding direction in the sliding surface. Therefore, the oil fed to the inner surface of the endless belt is retained by the unevenness of the sliding surface so that the friction with the inner surface of the endless belt can be reduced and high slidability can be ensured. Since each recess section is an elongated oval hollow extending in the width direction, the flow of oil can be promoted along the width direction in the sliding surface. Therefore, the friction with the inner surface of the endless belt is equalized with respect to the width direction.

In the sliding sheet of one embodiment, two columns composed of a plurality of the recess sections and adjacent to each other with respect to the sliding direction within the sliding surface are placed out of alignment with each other by ½ pitch with respect to the width direction.

In the sliding sheet of this embodiment, the oil which is going to flow in the sliding direction moves in a zigzag direction on the sliding surface because of the above-mentioned placement. Therefore, as compared with the case where two columns which are composed of a plurality of the recess sections and are adjacent to each other with respect to the sliding direction in the sliding surface are placed similarly with respect to the width direction, the oil can effectively be held by the unevenness. As a consequence, it becomes possible to further reduce the friction with the inner surface of the endless belt and to achieve high slidability. In addition, the flow of oil is promoted with respect to the width direction. Therefore, the friction with the inner surface of the endless belt is further equalized with respect to the width direction.

In the sliding sheet of one embodiment, a distribution density of the recess sections placed in a section equivalent to a downstream area with respect to the sliding direction within the sliding surface is higher than a distribution density of the recess sections placed in a section equivalent to an upstream area.

In the sliding sheet of this embodiment, the distribution density of the recess sections placed in a section which is equivalent to a downstream area with respect to the sliding direction within the sliding surface is higher than the distribution density of the recess sections placed in a section which is equivalent to an upstream area. As a result, the oil which is going to flow in the sliding direction tends to stagnate on the sliding surface. Therefore, oil can effectively be retained on the sliding surface. As a consequence, it becomes possible to further reduce the friction with the inner surface of the endless belt and to achieve high slidability.

In the sliding sheet of one embodiment, a distribution density of the recess sections placed in both end sections with respect to the width direction within the sliding surface is higher than a distribution density of the recess sections placed in a central section.

In the sliding sheet of this embodiment, the distribution density of the recess sections placed in both end sections with respect to the width direction within the sliding surface is higher than the distribution density of the recess sections placed in a central section. Therefore, the oil on the sliding surface becomes less likely to escape from the central section beyond both the end sections with respect to the width direction. Therefore, oil can effectively be retained on the sliding surface. As a consequence, it becomes possible to further reduce the friction with the inner surface of the endless belt and to achieve high slidability.

In the sliding sheet of one embodiment, a depth of the recess sections placed in a section equivalent to a downstream area with respect to the sliding direction within the sliding surface is larger than a depth of the recess sections placed in a section equivalent to an upstream area.

In the sliding sheet of this embodiment, the depth of the recess sections placed in a section equivalent to the downstream area with respect to the sliding direction within the sliding surface is larger than the depth of the recess sections placed in a section which is equivalent to the upstream area. Accordingly, the oil which is going to flow in the sliding direction tends to stagnate on the sliding surface. Therefore, oil can effectively be retained on the sliding surface. As a consequence, it becomes possible to further reduce the friction with the inner surface of the endless belt and to achieve high slidability.

In the sliding sheet of one embodiment, a depth of the recess sections placed in both end sections with respect to the width direction within the sliding surface is larger than a depth of the recess sections placed in a central section.

In the sliding sheet of this embodiment, the depth of the recess sections placed in both the end sections with respect to the width direction within the sliding surface is larger than the depth of the recess sections placed in the central section. Therefore, the oil on the sliding surface becomes less likely to escape from the central section beyond both the end sections with respect to the width direction. Therefore, oil can effectively be retained on the sliding surface. As a consequence, it becomes possible to further reduce the friction with the inner surface of the endless belt and to achieve high slidability.

As mentioned above, the manufacturing method for a sliding sheet according to the above described embodiments is a manufacturing method for manufacturing a sliding sheet for fixing devices, the sliding sheet being inserted in between an endless belt constituting one member out of two members which form a nip section for fixing operation and a pressure member for pressing the endless belt from an inner surface side toward the other member out of the two members, the sliding sheet comprising a single resin, and repeatedly having a thick section and a thin section at least with respect to a sliding direction of the endless belt due to substantial difference in resin amount per unit area corresponding to positions on a sheet surface, the manufacturing method comprising:

preparing a support base having, on a support face for supporting a polishing object, a plurality of projections respectively placed corresponding to the thin sections of the sliding sheet to be manufactured;

attaching a sheet material, which is made of a single resin having a fixed thickness, to the support face of the support base so as to be mounted on a plurality of the projections; and forming the thin section by slidably moving a polishing pad which is placed in contact with the sheet material from an opposite side to the support base so that the resin in regions corresponding to the respective projections on a surface of the sheet material which is in contact with the polishing pad is removed in an amount relatively larger than that of the resin in other remaining regions.

In the manufacturing method for a sliding sheet of one embodiment, a top end of the projection on the support face of the support base forms a convex curve.

In the manufacturing method for a sliding sheet in this embodiment, the top end of the projection on the support face of the support base is formed into a hemispherical convex curve, and therefore the sheet material is less likely to break during polishing operation compared to the projection having a sharp top end.

In the manufacturing method for a sliding sheet of one embodiment, the projection on the support face of the support base is formed into a column shape having the top end.

In the manufacturing method for a sliding sheet of this embodiment, a recess section made of a circular hollow can be formed as the thin section in a position corresponding to the projection within the surface of the sheet material which is in contact with the polishing pad.

In the manufacturing method for a sliding sheet of one embodiment, the projections on the support face of the support base are placed at lattice points at a constant pitch in two directions which are vertical to each other within the support face.

In the manufacturing method for a sliding sheet in this embodiment, a plurality of the recess sections can be formed in the state of being placed at the lattice points at the same constant pitch in two directions which are vertical to each other within the surface of the sheet material which comes into contact with the polishing pad.

In the manufacturing method for a sliding sheet of one embodiment, the projection on the support face of the support base is formed into a column shape having the top end and an elongated oval traverse section.

The term "transverse section" herein refers to a cross section parallel to the support face.

In the manufacturing method for a sliding sheet in this embodiment, the recess section which is made of an elongated oval hollow can be formed as the thin section in a position corresponding to the projection in the surface of the sheet material which comes into contact with the polishing pad.

In the manufacturing method for a sliding sheet of one embodiment, the projections on the support face of the support base are placed like a matrix at a constant pitch in two directions which are vertical to each other within the support face.

In the manufacturing method for a sliding sheet in this embodiment, a plurality of the recess sections can be formed like a matrix arranged at a constant pitch respectively in the sliding direction and the width direction within the sliding surface.

In the manufacturing method for a sliding sheet of one embodiment, the projection on the support face of the support base has a height corresponding to a difference in thickness between the thick section and the thin section of the sliding sheet to be manufactured.

In the manufacturing method for a sliding sheet in this embodiment, the difference in thickness between the thick section and the thin section of the sliding sheet can be set corresponding to the height of the projections on the support face of the support base.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sliding sheet for fixing devices inserted in between an endless belt constituting one member out of two members which form a nip section for fixing operation and a pressure member for pressing the endless belt from an inner surface side toward the other member out of the two members, wherein the sliding sheet comprises a single resin, and repeatedly has a thick section and a thin section at least with respect to a sliding direction of the endless belt due to substantial difference in resin amount per unit area corresponding to positions on a sheet surface.

2. A fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet comprises a single resin, and repeatedly has thick sections and thin sections at least with respect to a sliding direction and a width direction of the endless belt due to substantial differences in resin amount per unit area corresponding to positions on a sheet surface, each of the thin sections is equivalent to a recess section formed by locally removing the sliding surface of the resin which should be in contact with the endless belt, and each of the recess sections is a circular hollow.

3. The fixing device according to claim 2, wherein a plurality of the recess sections are placed at lattice points at a constant pitch in two directions which are vertical to each other within the sliding surface.

4. The fixing device according to claim 3, wherein an arrangement direction of a plurality of the recess sections is inclined 45 degrees in the sliding direction and the width direction within the sliding surface.

5. A fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet comprises a single resin, and repeatedly has thick sections and thin sections at least with respect to a sliding direction and a width direction of the endless belt due to substantial differences in resin amount per unit area corresponding to positions on a sheet surface, each of the thin sections is equivalent to a recess section formed by locally removing the sliding surface of the resin which should be in contact with the endless belt, and each of the recess sections is an elongated oval hollow extending in the width direction.

6. The fixing device according to claim 5, wherein a plurality of the recess sections are placed like a matrix at a constant pitch respectively in the sliding direction and the width direction within the sliding surface.

7. The fixing device according to claim 6, wherein two columns composed of a plurality of the recess sections and adjacent to each other with respect to the sliding direction within the sliding surface are placed out of alignment with each other by ½ pitch with respect to the width direction.

8. A fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet comprises a single resin, and repeatedly has thick sections and thin sections at least with respect to a sliding direction and a width direction of the endless belt due to substantial differences in resin amount per unit area corresponding to positions on a sheet surface, each of the thin sections is equivalent to a recess section formed by locally removing the sliding surface of the resin which should be in contact with the endless belt, and a depth of the recess sections placed in a section equivalent to a downstream area with respect to the sliding direction within the sliding surface is larger than a depth of the recess sections placed in a section equivalent to an upstream area.

9. A fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet comprises a single resin, and repeatedly has thick sections and thin sections at least with respect to a sliding direction and a width direction of the endless belt due to substantial differences in resin amount per unit area corresponding to positions on a sheet surface, each of the thin sections is equivalent to a recess section formed by locally removing the sliding surface of the resin which should be in contact with the endless belt, and a depth of the recess sections placed in both end sections with respect to the width direction within the sliding surface is larger than a depth of the recess sections placed in a central section.

10. A fixing device comprising:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, wherein the sliding sheet is made of a single resin, and has thick sections and thin sections that repeatedly appear on a surface in contact with the endless belt at least with respect to a sliding direction of the endless belt, wherein the thick sections and the thin sections are created by substantial differences in resin amount per unit area corresponding to positions on the sheet surface and are formed without deformation of the sliding sheet.

11. An image forming apparatus comprising a fixing device, wherein the fixing device comprises:

two members which form a nip section for allowing a recording material on which an image should be fixed to pass through, one member out of the two members being an endless belt;

a pressure member for pressing the endless belt from an inner surface side toward the other member out of the two members; and a sliding sheet inserted in between the endless belt and the pressure member, and wherein the sliding sheet is made of a single resin, and has thick sections and thin sections that repeatedly appear on a surface in contact with the endless belt at least with respect to a sliding direction of the endless belt, wherein the thick sections and the thin sections are created by substantial differences in resin amount per unit area corresponding to positions on the sheet surface and are formed without deformation of the sliding sheet.

12. The fixing device according to claim 10, wherein the sliding sheet repeatedly has thick sections and thin sections substantially corresponding to positions on the sheet surface with respect to a width direction of the endless belt.

13. The fixing device according to claim 10, wherein each of the thin sections is equivalent to a recess section formed by locally removing the sliding surface of the resin which should be in contact with the endless belt.

14. The fixing device according to claim 12, wherein each of the thin sections is equivalent to a recess section formed by locally removing the sliding surface of the resin which should be in contact with the endless belt.

15. The fixing device according to claim 10, wherein the resin is fluororesin.

16. The fixing device according to claim 10, wherein the resin is polyimide resin.

17. The fixing device according to claim 14, wherein a distribution density of the recess sections placed in a section equivalent to a downstream area with respect to the sliding direction within the sliding surface is higher than a distribution density of the recess sections placed in a section equivalent to an upstream area.

18. The fixing device according to claim 14, wherein a distribution density of the recess sections placed in both end sections with respect to the width direction within the sliding surface is higher than a distribution density of the recess sections placed in a central section.

* * * * *